United States Patent [19]

Assaf

[11] Patent Number: 5,010,735

[45] Date of Patent: Apr. 30, 1991

[54] CENTRIFUGAL HEAT ENGINE AND METHOD FOR USING THE SAME

[75] Inventor: Gad Assaf, Rehovot, Israel

[73] Assignee: Geophysical Engineering Company, Seattle, Wash.

[21] Appl. No.: 418,268

[22] Filed: Oct. 6, 1989

[51] Int. Cl.[5] ..... F01K 11/04

[52] U.S. Cl. ..... 60/669; 60/649; 60/673

[58] Field of Search ..... 60/649, 669, 673

[56] References Cited

U.S. PATENT DOCUMENTS

| | | | |
|---|---|---|---|
| 1,162,052 | 11/1915 | Hall | 60/649 X |
| 3,470,704 | 10/1969 | Kantor . | |
| 3,590,786 | 7/1971 | Doerner . | |
| 3,613,368 | 10/1971 | Doerner . | |
| 3,808,828 | 5/1974 | Kantor . | |
| 4,010,018 | 3/1977 | Kantor . | |
| 4,196,590 | 4/1980 | Fries | 60/649 X |

*Primary Examiner*—Allen M. Ostrager
*Attorney, Agent, or Firm*—Sandler, Greenblum & Bernstein

[57] ABSTRACT

A centrifugal heat engine comprises a first member rotatably mounted on a second member. The first member has an annular chamber on its periphery containing a vaporizable working fluid, and a central chamber separated from the annular chamber by a bulkhead. The central chamber contains an operating liquid and an hydraulic turbine mounted on the second member which projects into the central compartment and divides the same into two axially displaced compartments each of which contains operating liquid. The working fluid in the annular chamber is heated and vaporized. A conduit conducts vaporized working fluid in the annular chamber into one of the compartments wherein the vaporized working fluid expands in the operating liquid producing a liquid/gas mixture in the one compartment. Rotation of the first member creates a pressure differential between the two compartments that is related to the rotational speed of the first member and the density distribution of the fluids in the two compartments. The turbine contains a structure in cooperation with the first member for effecting a fluid path for the operating fluid between the two compartments such that rotation is imparted to the first member.

32 Claims, 1 Drawing Sheet

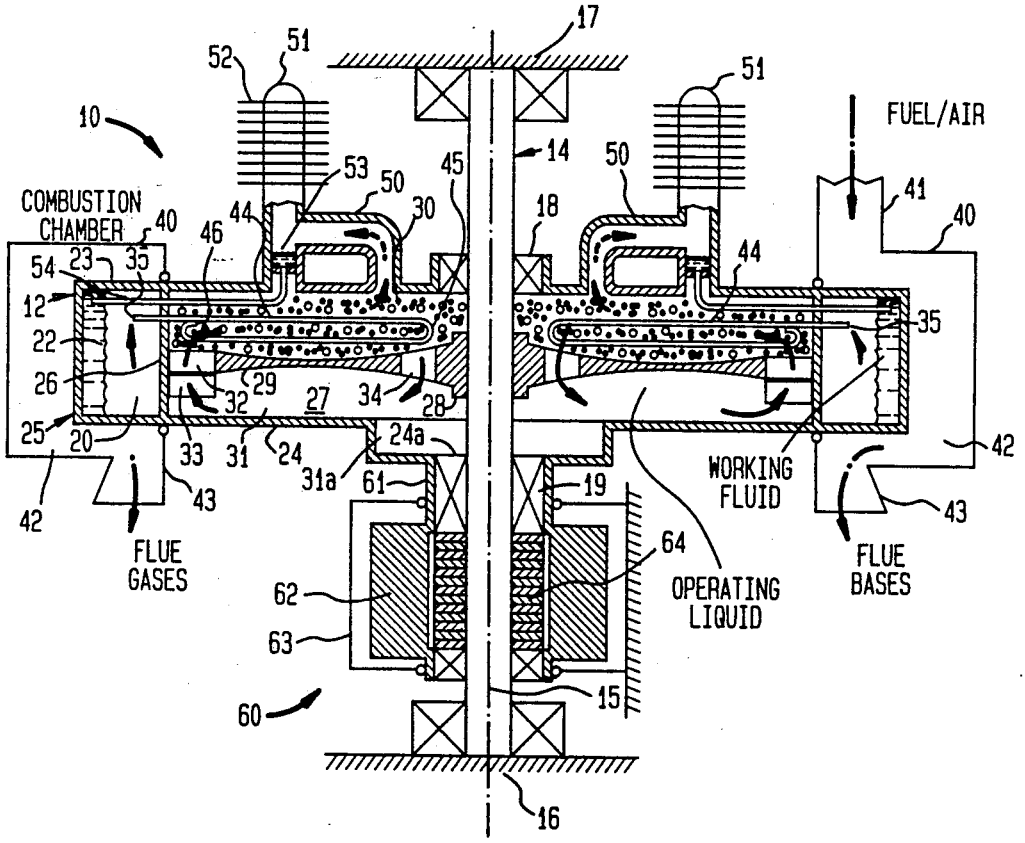
17
51
52
51
10
FUEL/AIR
14
50
53
50
45
41
COMBUSTION
CHAMBER
40
44
30
18
40
46
44
54
23
35
12
35
22
26
29
32
27
34
28
25
20
33
31
24
24a
31a
61
19
42
WORKING
FLUID
42
43
43
FLUE
GASES
64
FLUE
BASES
62
OPERATING
LIQUID
63
15
60
16

CENTRIFUGAL HEAT ENGINE AND METHOD FOR USING THE SAME

TECHNICAL FIELD

This invention relates to a centrifugal heat engine and to a method for using the same.

BACKGROUND

A centrifugal heat engine operating on the Rankine cycle and employing a rotatable boiler is disclosed in U.S. Pat. No. 3,590,786 wherein liquid working fluid in the boiler is held against a cylindrical, transverse heat transfer surface by centrifugal force created by rotation of the boiler. Power is generated using a separate stationary turbine and condenser utilizing vaporized working fluid produced by the boiler. As stated in this patent, rotatable boilers are advantageous because a sharp interface between liquid and vapor in the boiler is established by the centrifugal force acting on the liquid, the force effecting a heat flux much greater than can be achieved under normal gravity conditions. U.S. Pat. No. 3,613,368 discloses a Rankine cycle heat engine having a rotatable boiler and having a rotatable turbine and condenser as well.

Devices disclosed in these patents are advantageous because of their ability to utilize external combustion, and because of the large power output to physical size and weight achieved by such devices. It is therefore an object of the present invention to provide a new and improved centrifugal heat engine in order to further improve the power-to-size ratio of a centrifugal heat engine.

BRIEF DESCRIPTION OF THE INVENTION

A centrifugal heat engine according to the present invention comprises a first member rotatably mounted on a second member, the first member preferably having an annular chamber on its periphery containing a vaporizable working fluid, and a central chamber separated from the annular chamber by a bulkhead. The central chamber contains an operating liquid whose vapor pressure is low as compared to the vapor pressure of the working fluid. An hydraulic turbine is mounted in the second member and projects into the central chamber for dividing the same into two compartments, each of which contains operating liquid. Heating means are provided for heating and vaporizing the working fluid in the annular chamber. Preferably, conduit means are provided for conducting vaporized working fluid produced in the annular chamber into one of the compartments termed the expansion compartment wherein the vaporized working fluid expands in the operating liquid therein producing a liquid/gas mixture that is less dense than liquid in the second compartment. Rotation of the first member creates an added pressure differential between the two compartments, and thus across the turbine. The pressure differential is related to the rotational speed of the first member relative to the second member, and the density distribution of the fluids in the two compartments. The turbine and the first member are provided with interacting flow means for effecting a flow path for operating liquid between the two compartments in response to said differential pressure, the flow of operating liquid between the two compartments imparting rotation to the first member.

Even when the rotating chambers are relatively small, a very large centrifugal pressure head can be induced at a relatively low rotational speed. For example, a rotatable member whose cross-section is about 100 cm.$^2$ and whose diameter is about 40 cm. rotating at approximately 3600 RPM can produce about 200 KW utilizing water as both the working and operating fluids.

BRIEF DESCRIPTION OF THE DRAWINGS

An embodiment of the present invention is shown by way of example in the single FIGURE of the accompanying drawing which is a schematic vertical sectional view of a rotatable heat engine according to the present invention.

DETAILED DESCRIPTION

Referring now to the drawings, reference numeral 10 designates a centrifugal heat engine according to the present invention. Engine 10 comprises first member 12 rotatably mounted on second member 14. For purposes of illustrating the invention, member 14 is shown as a vertically mounted rigid shaft built-in at each end 16 and 17 for supporting member 12 by means of bearings 18, 19 for rotation in a horizontal plane about vertical axis 15.

Member 12 includes annular chamber 20 on its periphery, the annular chamber containing vaporizable working fluid 22. Specifically, chamber 20 is established by vertically spaced upper and lower disks 23, 24 in which bearings 18, 19 are respectively mounted, and an outer peripheral heat exchange surface 25 interconnecting the disks. The extent of chamber 20 is defined by cylindrical bulkhead 26 extending between the two disks. Thus, bulkhead 26 divides the interior of member 12 into outer annular chamber 20 and central chamber 27.

Rigidly connected to second member 14 is hydraulic turbine 28, the turbine having disk 29 oriented in a plane normal to the axis of rotation defined by axis 15 of shaft 14. Disk 29 projects into central chamber 27 and divides the same into two axially displaced compartments, namely upper compartment 30 and lower compartment 31. The periphery of turbine disk 29 is provided with tangential reaction blades 32 operatively associated with curved nozzle blades 33 attached to bulkhead 26 and which function as described below. Disk 29 also has a plurality of angularly displaced apertures 34 which interconnect compartments 30 and 31.

Each of compartments 30 and 31 contains operating liquid which, as described below, flows radially outwardly in lower compartment 31, through nozzles 33, and then upwardly and radially through blades 32 of the turbine into upper compartment 30. The flow path is completed by the downward flow of liquid from compartment 30 to compartment 31 by way of apertures 34. As described below, this flow pattern is established by reason of a pressure differential between compartments 30 and 31 established by the rotation of member 12 and the expansion of working fluid 22 in upper compartment 30. Reservoir **31*a* formed by external portion 24*a* of disk 24 permits operating fluid to collect therein when members 12 and 14** are not rotating.

The outer periphery of member 12 is surrounded by enclosure 40 which is stationary and to which a fuel air mixture is supplied via inlet 41. The annular space between enclosure 40 and the periphery of member 12 defines external combustion chamber 42 within which the fuel air mixture injected at 41 burns. The products of combustion are withdrawn from the combustion chamber via exhaust manifold 43.

Enclosure 40 and the fuel air mixture injected thereinto defines heating means for heating and vaporizing working fluid 22 in annular chamber 20. The rotation of member 12 causes working fluid 22 to be pressed outwardly against heat transverse surface 25 as shown in FIG. 1. The centrifugal force acting on working fluid 22 maintains the liquid portion of the working fluid in contact with heat transverse surface 25 and increases the pressure of liquid 22. Heat transfer through heat transverse surface 25 is very efficient and vaporizes working fluid in chamber 20. A plurality of U-shaped tubes 44, each having open end 35, terminating in chamber 20, conduct vaporized working fluid from chamber 20 into upper compartment 30 of central chamber 27. Each of tubes 44 extends radially inwardly towards the axis of rotation of member 12. Each tube 44 is provided with a hair-pin loop at distal end 45 so that outlet 46 of tube 44 terminates adjacent bulkhead 26. In this way, vaporized working fluid is injected into the liquid contained in upper compartment 30 at a plurality of angular positions around member 12 but adjacent the periphery of the turbine disk.

As shown in FIG. 1, the vaporized working fluid, on exiting from outlet 46 of tube 44 expands radially inwardly in the form of bubbles in the liquid in the upper compartment 30. The low pressure center of upper compartment 30 is adjacent the axis of rotation of member 12 where separation of the gas from the liquid can be effected. As explained below, a pressure gradient exists across the turbine by reason of the rotation of member 12 and the expansion of the working fluid in compartment 30. Specifically, the pressure gradient increases with radial distance from the axis of rotation of the turbine. Consequently, liquid contained in lower compartment 27 flows through nozzles 33 and then through blades 32 of the turbine imparting rotation to member 12 by reason of the reaction of the fluid against nozzles 33, turbine 28 rotating at a lower speed or even stationary.

Heat depleted and expanded working fluid near the center of rotation of member 12 is collected by a plurality of conduits 50 connected to top disk 23 of the member 12. These conduits lead to respective vertical condenser tubes 51 mounted on disk 23 adjacent bulkhead 26 so that the axis of these tubes is parallel to the axis of rotation of member 12. Tubes 51 are provided with fins 52 to enhance the transfer of heat contained in the exhausted vaporized working fluid to the atmosphere as the tubes rotate in the air. The vapor exhausted into tubes 51 condenses therein producing condensed working fluid that collects in condensate pool 53 at the bottom of each of tubes 51. Return conduit 54 connects pool 53 directly to liquid 22 contained in chamber 20. The hydrostatic head of pool 53 coupled with the centrifugal force exerted on the condensate by reason of rotation of member 12 is sufficient to return the condensate to pressurized liquid 22 whereby the working fluid cycle repeats.

In order to obtain useful work from the apparatus described above, generator 60 is coupled to rotatable member 12. Specifically, member 12 is provided with sleeve 61 rigidly connected to rotor 62 of generator 60 such that rotor 62 rotates as member 12 rotates. Rotor 62 is encased in stationary housing 63 for the purposes of reducing windage. Stator 64 of the generator is connected to first member 14 and is in operative relationship to rotor 62.

The basis of the operation of the apparatus described above is the pressure differential that exists between upper chamber 30 and lower chamber 31. Given a rotating liquid, the pressure gradient established thereby can be expressed as:

$$P_2 = P_1 + \int \rho\omega^2 r dr \quad (1)$$

where $P_2$ is the pres nearer the periphery of the rotating fluid and $P_1$ is the pressure nearer the center of rotation; $\omega$ is the angular velocity which is assumed to be constant; and r is the radial distance from the center of rotation. Stated otherwise, the pressure gradient produced by rotating fluids can be written as:

$$\delta p/\delta r = \rho\omega^2 r \quad (2)$$

where $\delta p/\delta r$ is a partial derivative that defines the rate of change of pressure difference as a function of radial distance from the center of rotation. Integration of Eq. (1) for the liquid compartments yields the following pressure difference between the two compartments:

$$\Delta p = \Delta\rho\omega^2(r_2^2 - r_1^2)/2 \quad (3)$$

where $\Delta\rho$ is the average density difference between the two compartments. Furthermore, it can be shown that, if the vapor expansion of the working fluid is essentially isothermal and follows the Gas Law, Eq. (1) can be integrated to yield, the following:

$$P_2 = P_1 \exp [\omega^2\{(r_2^2 - r_1^2)/2xRT\} - v_1(1-x)(P_2 - P_1)/xRT] \quad (4)$$

where:

$\omega$ = the angular of velocity (radians/second)

$r_2$ = radial distance (cm.) near the periphery of the rotating fluid $r_1$ = radial distance (cm.) near the center of rotation of the rotating fluid x = mixing ratio of gas to liquid R = gas constant for working fluid (J/Kg°K.)

T = temperature (°K.)

$v_1$ = specific volume of liquid ($m^3$/Kg)

Eq. (3) assumes that the hydrostatic pressure, compared to the centrifugal pressure, is small enough to be neglected which is the case except, perhaps near the center of the rotating fluid.

The principles described above are applicable to a centrifugal heat engine wherein the operating liquid is molten lead whose density is 11,000 Kg/$m^3$. In such case, where water is the working fluid, the average mixture density in the upper compartment would be around 7000 Kg/$m^3$. At 3600 RPM, with a turbine wheel 20 cm. in radius, $r_2$ = 20 cm., $r_1$ = 10 cm., a pressure difference of 40 bar would be produced. Thus, even with an extremely small rotating chamber, it is possible to induce a centrifugal pressure head of 40 atmospheres with a relatively low rotational speed. When the operating liquid is water, it is possible to generate a pressure head of 4 atmospheres with the same dimensions and rotational speed. On the basis that a transfer of one $m^3$/sec of liquid across a pressure head of 40 atmospheres can generate 4 megawatts of useful mechanic power, a rotatable heat engine of only 100 $cm.^2$ in cross-section with a diameter of 40 cm can produce 200 kw. Thus, the engine of the present invention is extremely intensive and compact.

While the drawing shows an electrical generator coupled to the rotatable member, the centrifugal heat engine of the present invention, and the compact nature of the engine is conducive to directly coupling the output to a gear member by which a vehicle, for example, can be driven. Other types and methods of mechanical-to-mechanical, or mechanical-to-hydraulic connections can be utilized.

The embodiment of the centrifugal heat engine of the present invention described above is advantageous because it provides for separately vaporizing the working fluid in the annular peripheral chamber before the vapor is introduced into the rotating operating liquid in the inner chamber. This approach prevents instability and too rapid boiling of the working fluid and is superior to introducing liquid working fluid into the rotating operating fluid where vaporization and then expansion would take place. Moreover, the radial distance of the annular chamber, which acts as a boiler, from axis of rotation 15 is larger than the radial distance of condenser tubes 51 and condensate pool 53 from the axis of rotation with the result that a centrifugal pumping action occurs on the working fluid condensate present in pool 53 at the bottom of tubes 51 such that the latter flows into the boiler even though the operating liquid is more dense than the working fluid. Moreover, the hairpin shape of tube 44 prevents the return flow of operating liquid into the boiler when the boiler pressure is reduced.

Although both the first member containing the operating liquid and the liquid itself rotate at about the same speed, and the turbine disc can be substantially stationary. In order to reduce tangential frictional losses, the turbine can be made to rotate at a velocity different from that of the first member. Furthermore, the diameter of the turbine should also be made as small as possible. Radial frictional losses associated with the radial flow of the operating liquid relative to the turbine can be reduced by increasing the depth of the second chamber containing the turbine. Moreover, it can be shown that windage losses associated with the generator can be reduced if the generator is axially elongated. Frictional losses due to the flue gases acting on rotating heat transfer surface 25 of the boiler will be very small because the high temperature of the gases results in a very small density of the flue gases. Finally, thermal efficiency can be improved if an air-preheater is used in association with the combustion air supplied to the combustion chamber.

Water is a reasonable choice as an working fluid because of its temperature stability even at 1000° C. At such temperature, however, the saturated pressure of water will be very high requiring thick walls to contain the liquid, and this would reduce the heat exchange rate. By using hygroscopic solutions for the working fluid, the equivalent boiler pressure, even at higher temperatures, will be relatively small. Suitable solutions may be NaOH, LiCl, or $LiNO_3$. If a boiler pressure is to be limited to 40 bar, the use of water as the working fluid requires a boiler temperature of 250° C. Assuming a condenser temperature of 100° C., producing a pressure of 1 bar, the thermodynamic efficiency of the heat engine will be about 25%. If a hygroscopic solution were used instead, and the boiler pressure maintained at 40 bar, the boiler temperature would be about 350° C. and the thermodynamic efficiency would be about 33%.

Other suitable working fluids having relatively low pressures at relatively high temperatures include benzene ($C_6H_6$), aluminum bromide ($AlBr_3$), sulfur, and alkali metals, e.g., sodium, potassium, etc. Other operating fluids include molten salts, e.g., a mixture of sodium nitrates and other salts commonly used in industry. High boiler pressures and consequently high pressure differences across the hydraulic turbine permit relatively low operating fluid flow rates, whereas low boiler pressures and low pressures across the turbine require high operating fluid flow rates. The preferred range for boiler pressure and pressure difference across the hydraulic turbine is 5–10 bar.

The size of the condenser can be minimized under the condition that the expansion of the working fluid is adiabatic. Such type of expansion will be achieved if the operating fluid is stratified. That is to say, the operating liquid should be hot at the outer edges of compartment 27, and cold at the center. From a practical standpoint, this is difficult to achieve. However, by selecting an operating liquid that does not mix with the working fluid (e.g., oil and water), and if the expansion is made to proceed at a high speed to produce large bubbles, the heat exchange between the bubbles of working fluid and the operating liquid can be reduced. In such case, a semi-adiabatic expansion will be effected. Alternatively, a semi-adiabatic expansion will result when the temperature of the operating liquid is small compared with the temperature of the boiler and higher than the condenser temperature.

While the above-described embodiment refers to a fuel air mixture in an enclosure as a heating means, other heat sources such as flue gases, hot steam or fluid produced from different heat sources such as geothermal sources or industrial heat sources, as well as heat produced from nuclear processes or from solar radiation (e.g., from concentrated solar radiation) can be used in a heating means in a centrifugal heat engine in accordance with the present invention.

The advantages and improved results furnished by the method and apparatus of the present invention are apparent from the foregoing description of the preferred embodiment of the invention. Various changes and modifications may be made without departing from the spirit and scope of the invention as described in the appended claims.

What is claimed is:

1. A centrifugal heat engine comprising:

(a) a first member rotatably mounted on a second member;

(b) said first member having an annular chamber on its periphery containing a vaporizable working fluid, and a central chamber separated from the annular chamber by a bulkhead, said central chamber containing an operating liquid;

(c) an hydraulic turbine mounted on said second member and projecting into said central chamber for dividing the same into two axially displaced compartments each of which contains operating liquid;

(d) heating means for heating and vaporizing the working fluid in said annular chamber;

(e) conduit means for conducting vaporized working fluid produced in said annular chamber into one of said compartments wherein the vaporized working fluid expands in the operating liquid producing a liquid/gas mixture in said one compartment, rotation of said first member relative to the second member creating a pressure differential between said two compartments which is related to the rotational speed of the first member and the density distribution of the fluids in the second compartment; and (f) flow means on said turbine and said first member for effecting a flow path for operating fluid between said compartments in response to said pressure differential thereby imparting rotation to said first member which creates said pressure gradient in said operating fluid.

2. A centrifugal heat engine according to claim 1 including condenser means mounted on said first member and rotatable therewith for condensing vaporized working fluid into liquid condensate.

3. A centrifugal heat engine according to claim 2 wherein said condenser means includes an elongated tube whose axis is parallel to the rotational axis of the first member.

4. A centrifugal heat engine according to claim 2 wherein said condenser means is constructed and arranged so that centrifugal force assists in the return of said liquid condensate to the liquid working fluid in said annular chamber.

5. A centrifugal heat engine according to claim 1 wherein said hydraulic turbine includes a plurality of nozzles rigidly attached to said bulkhead, and a stationary turbine disk having axially flow blades on its periphery operatively positioned adjacent said nozzles.

6. A centrifugal heat engine according to claim 5 wherein said disk includes aperture means remote from the periphery of the disk for interconnecting the two compartments.

7. A centrifugal heat engine according to claim 6 wherein said conduit means is in the form a U-shaped tube passing through the bulkhead and extending radially toward the axis of rotation of the first member.

8. A centrifugal heat engine according to claim 7 wherein said tube has two open ends, one located in said annular chamber and the other located adjacent the bulkhead in the upper of the two compartments comprising the central chamber.

9. A centrifugal heat engine according to claim 1 wherein said heating means includes a combustion chamber operatively associated with the annular chamber of the first member.

10. A centrifugal heat engine according to claim 1 including an electrical generator coupled to said first member.

11. A centrifugal heat engine according to claim 10 wherein said generator includes a rotor connected to said first member, and a stator connected to said second member, said rotor surrounding said stator.

12. A centrifugal heat engine according to claim 1 wherein said working fluid is water.

13. A centrifugal heat engine according to claim 1 wherein said working fluid is hygroscopic.

14. A centrifugal heat engine according to claim 13 wherein said working fluid is selected from the group consisting of NaOH, LiCl, and $LiNO_3$.

15. A centrifugal heat engine according to claim 1 wherein the expansion of the working fluid in the operating liquid is essentially adiabatic.

16. A centrifugal heat engine according to claim 1 wherein heating means includes flue gases.

17. A centrifugal heat engine according to claim 1 wherein said heating means includes a geothermal source.

18. A centrifugal heat engine according to claim 1 wherein said heating means includes an industrial heat source.

19. A centrifugal heat engine according to claim 1 wherein said heating means includes solar radiation.

20. A method for operating a heat engine comprising:

(a) rotating a fluid about an axis to induce a radial pressure gradient therein;

(b) adding heat to the rotating fluid and causing it to expand radially towards the axis of rotation of said fluid;

(c) using the expanded fluid to create a pressure differential across a hydraulic turbine; and (d) generating power as a consequence of liquid flow through the turbine due to said pressure differential.

21. A method according to claim 20 wherein said fluid expands as a two-phase mixture of liquid and gas.

22. A method according to claim 21 wherein said fluid comprises a working fluid that is vaporized when heat is added, and a liquid operating fluid that operates said turbine.

23. A method according to claim 22 wherein said working fluid is water.

24. A method according to claim 22 wherein said working fluid is benzene.

25. A method according to claim 22 wherein said working fluid is aluminum bromide.

26. A method according to claim 22 wherein said working fluid is sulfur.

27. A method according to claim 22 wherein said working fluid is an alkali metal.

28. A method according to claim 22 wherein said working fluid is a molten salt.

29. A method according to claim 22 wherein said working fluid is an oil.

30. A centrifugal heat engine comprising:

(a) a chamber having an axis and containing a liquid;

(b) means dividing the chamber into axially separate compartments each of which contains liquid;

(c) means for vaporizing a working fluid;

(d) means for expanding vaporized working fluid in one of the compartments and producing a pressure difference between the compartments; and (e) means responsive to said pressure difference for imparting rotation to said chamber.

31. A centrifugal heat engine according to claim 30 wherein said means responsive to said pressure difference is an hydraulic turbine.

32. A centrifugal heat engine according to claim 30 wherein said pressure difference is less than 10 bar.

* * * * *